US010024078B1

(12) United States Patent
Nidam

(10) Patent No.: US 10,024,078 B1
(45) Date of Patent: Jul. 17, 2018

(54) DOOR HANDLE INSTALLATION SYSTEM AND METHOD OF USE

(71) Applicant: Sagi Nidam, Dallas, TX (US)

(72) Inventor: Sagi Nidam, Dallas, TX (US)

( * ) Notice: Subject to any disclaimer, the term of this patent is extended or adjusted under 35 U.S.C. 154(b) by 218 days.

(21) Appl. No.: 15/092,472

(22) Filed: Apr. 6, 2016

Related U.S. Application Data

(60) Provisional application No. 62/259,339, filed on Nov. 24, 2015.

(51) Int. Cl.
*E05B 3/00* (2006.01)
*E05B 3/04* (2006.01)

(52) U.S. Cl.
CPC ..... *E05B 3/04* (2013.01)

(58) Field of Classification Search
CPC . Y10T 292/91; Y10T 292/85; Y10T 70/8541; Y10T 16/469; E05B 3/003; E05B 3/06; E05B 13/101; E05B 13/005; E05B 2015/042
USPC .. 292/336.3, 336.5, 347, 348, 349–351, 355
See application file for complete search history.

(56) References Cited

U.S. PATENT DOCUMENTS 2,810,600 A * 10/1957 Marron ..... E05B 15/02 292/357
2,827,323 A * 3/1958 Kessel ..... E05B 3/003 292/352
5,409,278 A * 4/1995 Harcourt ..... E05L 33/06 292/348
5,960,517 A * 10/1999 Sprekeler ..... E05B 3/065 292/336.3
6,532,629 B2 * 3/2003 Armstrong ..... E05B 3/003 16/414
6,745,602 B2 * 6/2004 Nakasone ..... E05B 3/003 16/441

* cited by examiner

*Primary Examiner* — Mark A Williams
(74) *Attorney, Agent, or Firm* — Eldredge Law Firm, LLC; Richard Eldredge

(57) ABSTRACT

A door installation system includes a spindle rotatably attached to an exterior knob; a first screw post secured to a front surface of the spindle; a second screw post secured to the front surface of the spindle; a cover secured to an interior knob at a first surface. The cover includes a first recess that engages with the first screw post; and a second recess that engages with the second screw post.

3 Claims, 5 Drawing Sheets

DOOR HANDLE INSTALLATION SYSTEM AND METHOD OF USE

BACKGROUND

1. Field of the Invention

The present invention relates generally to door handles, and more specifically, to a door handle installation system.

2. Description of Related Art

Door handle installation systems are well known in the art and are effective means to secure a door handle to a door to facilitate user passage through a doorway. For example, FIG. 1 depicts a conventional door knob installation system 101 comprising an interior knob 103 in communication with an exterior knob 105, the exterior knob 105 comprising a spindle 107 and screw posts 109 and 111, mounting plate 113 and a rose cover or trim 115.

Referring now to FIG. 2, during installation, exterior knob 103 and mounting plate 113 secure to one another on opposite sides of a door (not shown) by screwing the mounting plate 113 to the one or more screw posts 109, 111, inserting the interior door knob 103 over the spindle 107, and concealing the mounting plate 113 under the rose cover 115, these features are shown in boxes 201, 203, 205, and 205 of the exemplary flowchart.

One of the problems commonly associated with system 101 is its limited use. For example, securing mounting plate 113 to exterior knob 103 requires access to tools such as a screw driver while concealing mounting plate 113 under rose cover 115 can be a tedious and non-intuitive process for users without experience in door knob installation.

Accordingly, although great strides have been made in the area of door handle systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
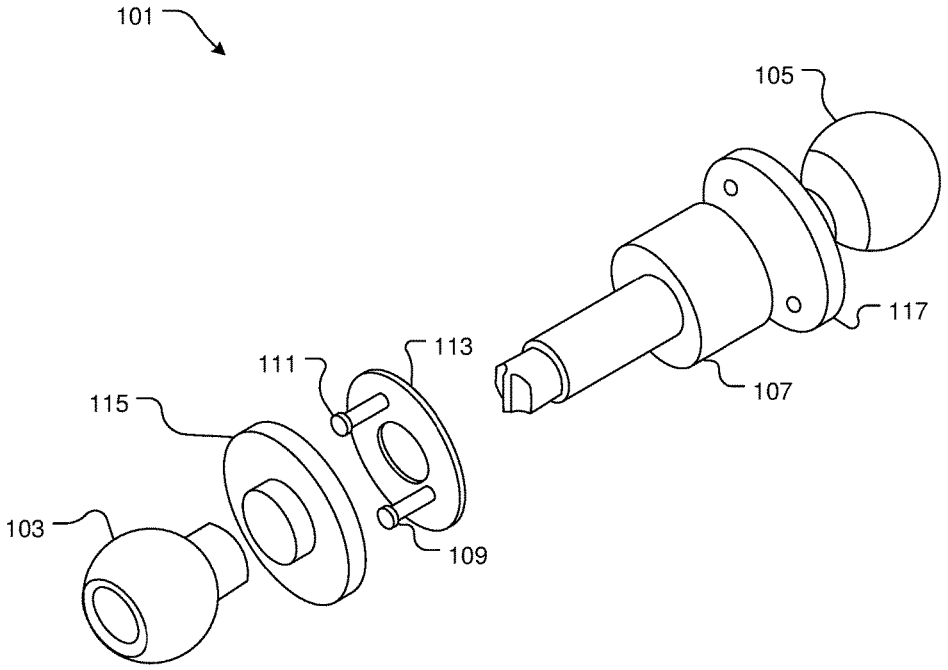
FIG. 1 (Prior Art)
FIG. 1 is an exploded view of a common door handle installation system.
Figure 2:
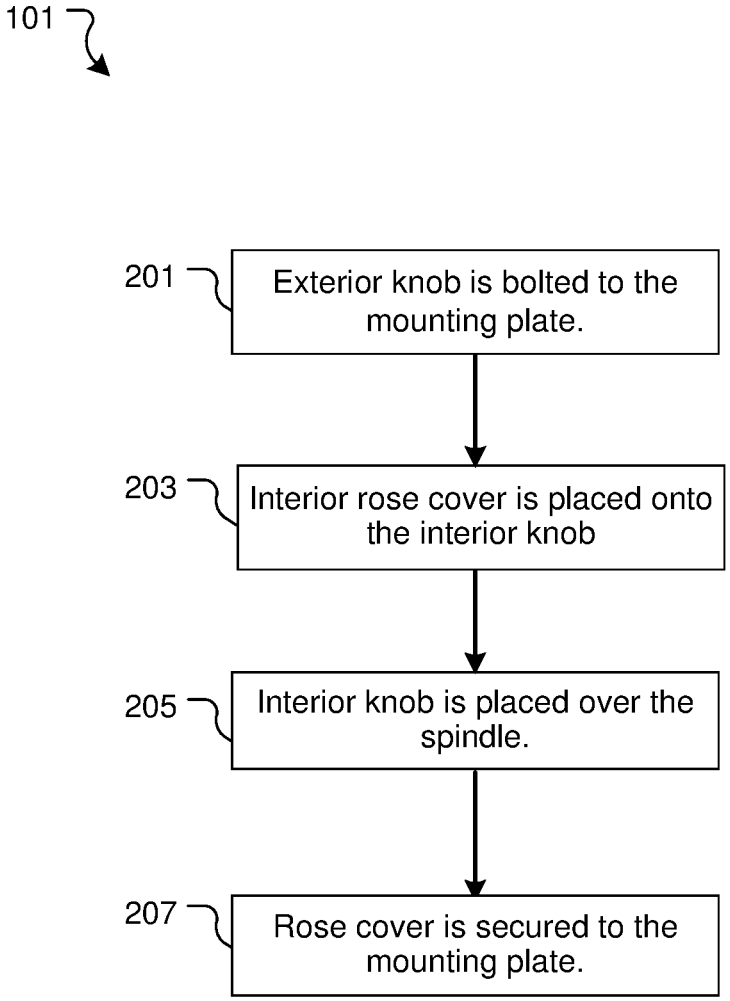
FIG. 2 is a flowchart depicting the process of FIG. 1.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional filtration systems. Specifically, the system and method of the present application provides a rapid and effective means to install a door handle without tools or training. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 3:
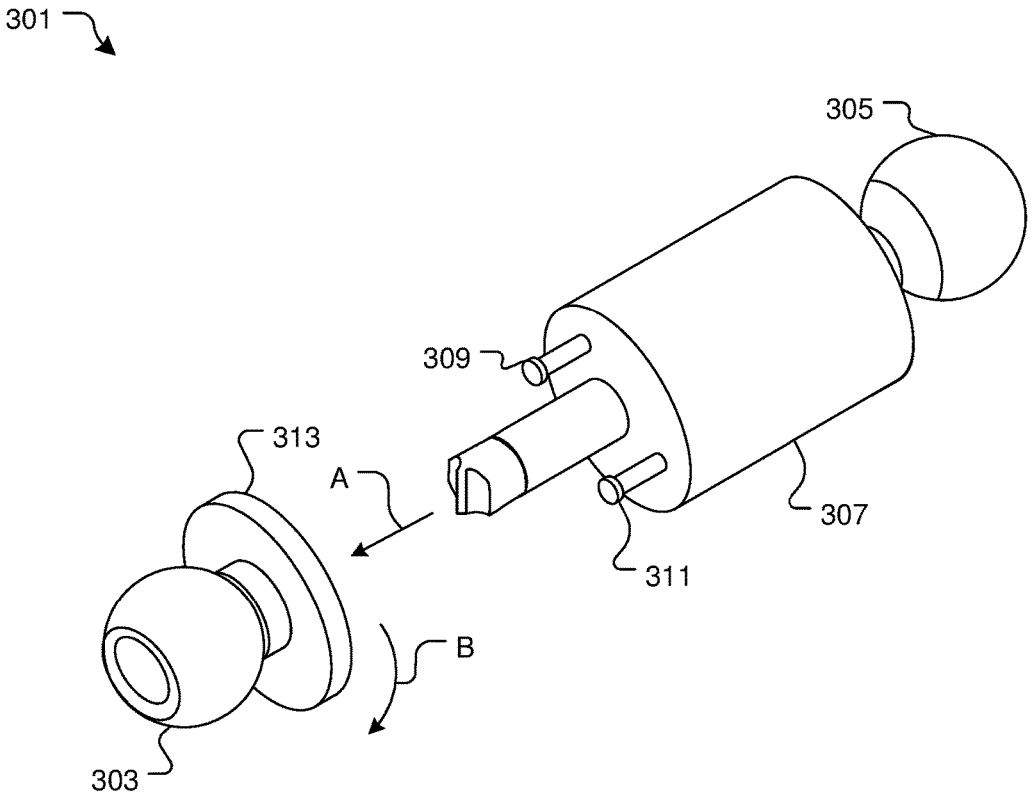
FIG. 3 is an exploded view of a door handle installation system in accordance with a preferred embodiment of the present application.

Referring now to the drawings wherein like reference characters identify corresponding or similar elements throughout the several views, FIG. 3 depicts an exploded view of a door handle installation system in accordance with a preferred embodiment of the present application. It will be appreciated that system 301 overcomes one or more of the above-listed problems commonly associated with conventional door handle installation systems.

In the contemplated embodiment, system 301 comprises an interior knob 303 in communication with an exterior knob 305, the exterior knob 305 comprising a spindle 307 and one or more screw posts 309 and 311, via a rose cover or trim 313. During installation, interior knob 303 inserts over spindle 307 as depicted by motion A, and rose cover 313 secures directly to screw posts 309 and 311 as depicted by motion B. Although not shown, the spindle 307 includes the necessary components to actuate levers and other components configured to open, close, and lock a door. The spindle and other components of the system 301 are adapted to fit within a hole extending through a thickness of the door (not shown).

It should be appreciated that one of the unique features believed characteristic of the present application is that rose cover 313 secures the whole system 301 to a door by mounting directly to screw posts 309 and 311 without the need for a mounting plate, tools, or user training. This features is achieved via one or more recesses extending partially through the thickness of the rose cover 313, as depicted in FIG. 4 and discussed more in detail below.

Figure 4:
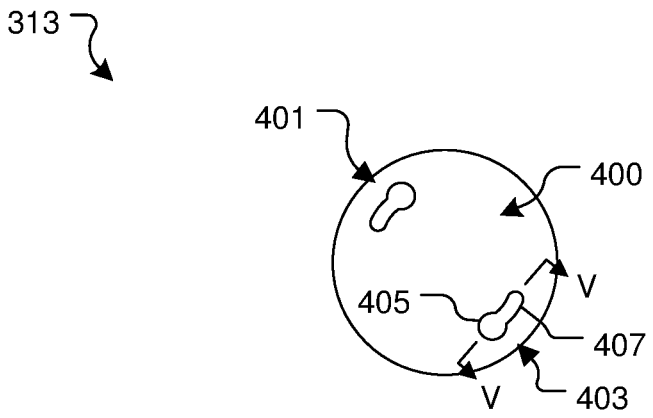
FIG. 4 is a bottom view of the rose cover of FIG. 3.

Referring now to FIG. 4, a bottom view of the rose cover 313 of system 301 is shown. In the preferred embodiment rose cover 313 comprises one or more recesses 401, 403, wherein the one or more recesses are finished such that they can receive the one or more screw posts of the exterior knob (see FIG. 3). It is contemplated and will be appreciated that recesses 401, 403 comprise a threaded or inclined construction such that rose cover 313 can more tightly or loosely secure the components of system 301 by twisting the rose cover 313 over the screw posts (see FIG. 3). Alternative embodiments also contemplate varying the dimensions of the screw posts to accommodate installation preferences, e.g., altering the seal and torque of the installation.

As depicted, the recess 403 includes a circular portion 405 that receives the head 503 of the screw post 309 and an elongated channel 407 configured to receive the shaft of the screw post 309. It should be understood that recess 402 shares the same characteristics as recess 403.

Figure 5A:
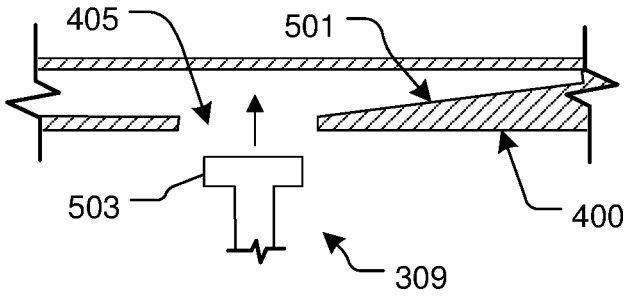
FIGS. 5A and 5B are cross-sectional side views of the recesses taken at V-V of FIG. 4.
Figure 5B:
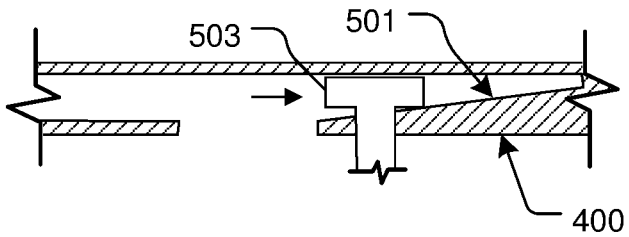

In FIGS. 5A and 5B, cross-sectional side views of the recess 403 is shown taken at V-V of FIG. 4. In one contemplated embodiment, the recesses includes an angled surface 501 relative to a top surface 400 of the rose cover. During use, the angled surface 501 effectively locks the head 503 in a fixed position to prevent slippage, as shown in FIG. 5B. This feature also allows installation of the system with different doors having varying thicknesses without the need to adjust the screw posts.

In an alternative embodiment, it is contemplated having the screw posts threadedly attached to the spindle. This feature allows selective adjustment of the overall length of the screw posts for securing the system to different doors having varying thicknesses.

Figure 6:
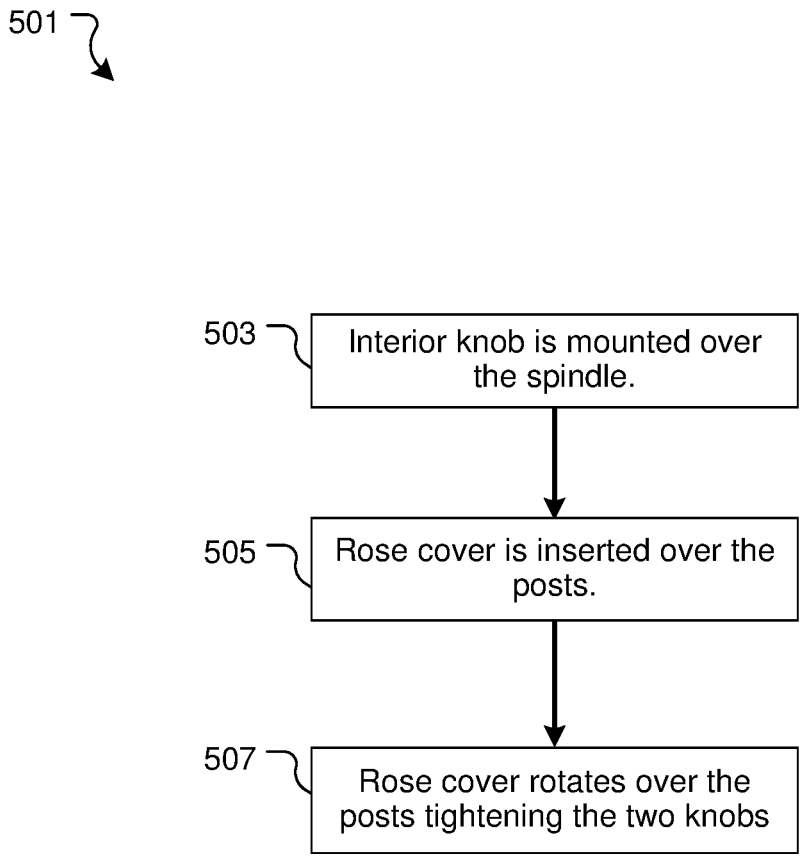
FIG. 6 is a flowchart depicting the preferred process of FIG. 3.

FIG. 6 depicts the preferred method 501, which includes the steps of mounting interior knob 303 over spindle 307 as depicted in box 503, securing rose cover 313 over screw posts 309, 311 as depicted in box 505, and rotating the rose cover 313 over the screw posts 309, 311 along recesses 401, 403 to tighten the secured components of the system as depicted in box 507.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A door installation system, comprising:

a spindle rotatably attached to an exterior knob, the spindle having a cylindrical elongated body;

a first screw post secured to and protruding from a front surface of the body of the spindle;

a second screw post secured to and protruding from the front surface of the body of the spindle; and a cover rotatably secured to an interior knob at a first surface, the cover having:

a first recess that engages with the first screw post, the first recess having:

a first angled surface configured to receive a head of the first screw post; and a second recess that engages with the second screw post, the second recess having:

a second angled surface configured to receive a head of the second screw post;

wherein the first recess and the second recess secure the cover to the spindle; and wherein the first and second angled surfaces are configured for selective adjustment of the tightness between the spindle and the cover.

2. The system of claim 1, wherein the first screw post is threadedly attached to the spindle.

3. The system of claim 2, wherein the first screw post is adjustable.

* * * * *